US006866556B2

(12) United States Patent
Liang

(10) Patent No.: US 6,866,556 B2
(45) Date of Patent: Mar. 15, 2005

(54) METHOD OF MANUFACTURING A CATHODE RAY TUBE (CRT) HAVING A COLOR FILTER

(75) Inventor: Kangning Liang, Lancaster, PA (US)

(73) Assignee: Thomson Licensing S. A., Boulogne-Billancourt (FR)

( * ) Notice: Subject to any disclaimer, the term of this patent is extended or adjusted under 35 U.S.C. 154(b) by 28 days.

(21) Appl. No.: 10/387,906

(22) Filed: Mar. 13, 2003

(65) Prior Publication Data

US 2004/0178716 A1 Sep. 16, 2004

(51) Int. Cl.[7] ..... H01J 9/00
(52) U.S. Cl. ..... 445/24; 430/27; 313/461
(58) Field of Search ..... 445/23–25; 313/461; 430/27, 23; 427/168

(56) References Cited

U.S. PATENT DOCUMENTS

| | | | | |
|---|---|---|---|---|
| 3,623,867 A | | 11/1971 | Saulnier | 96/36.1 |
| 5,478,694 A | | 12/1995 | Maerz et al. | 430/257 |
| 6,300,022 B2 | * | 10/2001 | Kim et al. | 430/27 |
| 6,527,842 B1 | | 3/2003 | Adams et al. | 106/31.26 |

FOREIGN PATENT DOCUMENTS

| | | | |
|---|---|---|---|
| EP | 1 077 469 A2 | 2/2001 | H01J/29/89 |
| EP | 1 089 313 A2 | 4/2001 | H01J/29/86 |

* cited by examiner

*Primary Examiner*—Joseph Williams
(74) *Attorney, Agent, or Firm*—Joseph S. Tripoli; Harvey D. Fried; Richard LaPeruta, Jr.

(57) ABSTRACT

A method of manufacturing a cathode ray tube (CRT) having a color filter luminescent screen assembly is disclosed. The luminescent screen assembly is formed on an interior surface of a faceplate panel of the CRT tube. The luminescent screen assembly includes a patterned light-absorbing matrix that defines a plurality of sets of fields corresponding to one of a blue region, a red region and a green region. A color filter is formed in one of the plurality of sets of fields. The color filter is formed by applying a photosensitive material layer on the inner surface of the faceplate panel and exposing one of the sets of fields corresponding to the blue region, the red region or the green region, to harden the photosensitive material in such region. A pigment layer, having a color that corresponds to the color of the region of hardened photosensitive material, is then applied over the exposed photosensitive material layer. After the pigment layer is applied, the unhardened photosensitive material layer is removed to form the color filter.

8 Claims, 8 Drawing Sheets

METHOD OF MANUFACTURING A CATHODE RAY TUBE (CRT) HAVING A COLOR FILTER

BACKGROUND OF THE INVENTION

1. Field of the Invention

The invention relates to a color cathode ray tube (CRT) and, more particularly to the manufacturing of a luminescent screen assembly having at least one color filter.

2. Description of the Related Art

A color cathode ray tube (CRT) typically includes an electron gun, an aperture mask, and a screen. The aperture mask is interposed between the electron gun and the screen. The screen is located on an inner surface of a faceplate of the CRT tube. The aperture mask functions to direct electron beams generated in the electron gun toward appropriate color-emitting phosphors on the screen of the CRT tube.

The screen may be a luminescent screen. Luminescent screens typically comprise an array of three different color-emitting phosphors (e.g., green, blue and red) formed thereon. Each of the color-emitting phosphors is separated from another by a matrix line. The matrix lines are typically formed of a light absorbing black, inert material.

In order to enhance the color contrast of the luminescent screen, a pigment layer, or color filter, may be formed between the faceplate panel and the color-emitting phosphor. The color filter typically has a color that corresponds to the color of the color-emitting phosphor formed thereon (e.g., a red-emitting phosphor is formed on a red pigmented filter). The color filter transmits light that is within the emission spectral region of the phosphor formed thereon and absorbs ambient light in other spectral regions, providing a gain in color contrast.

The color filters are typically formed using a subtractive process in which the filter layer is deposited on the interior of the faceplate panel, and, in a subsequent development process, select portions of the filter layer are removed. Unfortunately, for resist-based color filter formulations, agglomerates may form when the pigment is mixed with the resist polymer (e.g., polyvinyl alcohol (PVA) or polyvinyl pyrrolidone (PVP). Agglomerates may undesirably lead to non-uniform pigment distribution within the color filter. Additionally, it is difficult to harden resist-based color filter formulations that contain pigments having strong absorption peaks below 500 nm, reducing the line-width control of the color filter.

Thus, a need exists for a method of forming a color filter cathode ray tube (CRT) that overcomes the above drawbacks.

SUMMARY OF THE INVENTION

The present invention relates to a method of manufacturing a cathode ray tube (CRT) having a color filter luminescent screen assembly. The luminescent screen assembly is formed on an interior surface of a faceplate panel of the CRT tube. The luminescent screen assembly includes a patterned light-absorbing matrix that defines a plurality of sets of fields corresponding to one of a blue region, a red region and a green region.

A color filter is formed in one of the plurality of sets of fields. The color filter is formed by applying a photosensitive material layer on the inner surface of the faceplate panel and exposing one of the sets of fields corresponding to the blue region, the red region or the green region, to harden the photosensitive material in such region. A pigment layer, having a color that corresponds to the color of the region of hardened photosensitive material, is then applied over the exposed photosensitive material layer. The pigment layer may be applied from an aqueous suspension comprising pigment, one or more surface-active agents and a gelling agent. The gelling agent prevents unhardened photosensitive material from dissolving into the pigment suspension so as to form agglomerates. Furthermore, the gelling agent retains the photosensitive material layer in unhardened areas preventing deposition of the pigment directly on the surface of the faceplate panel. After the pigment layer is applied, the unhardened photosensitive material layer is removed to form the color filter.

BRIEF DESCRIPTION OF THE DRAWINGS

The invention will now be described in greater detail, with relation to the accompanying drawings, in which.

DETAILED DESCRIPTION OF THE PREFERRED EMBODIMENT

Figure 1:
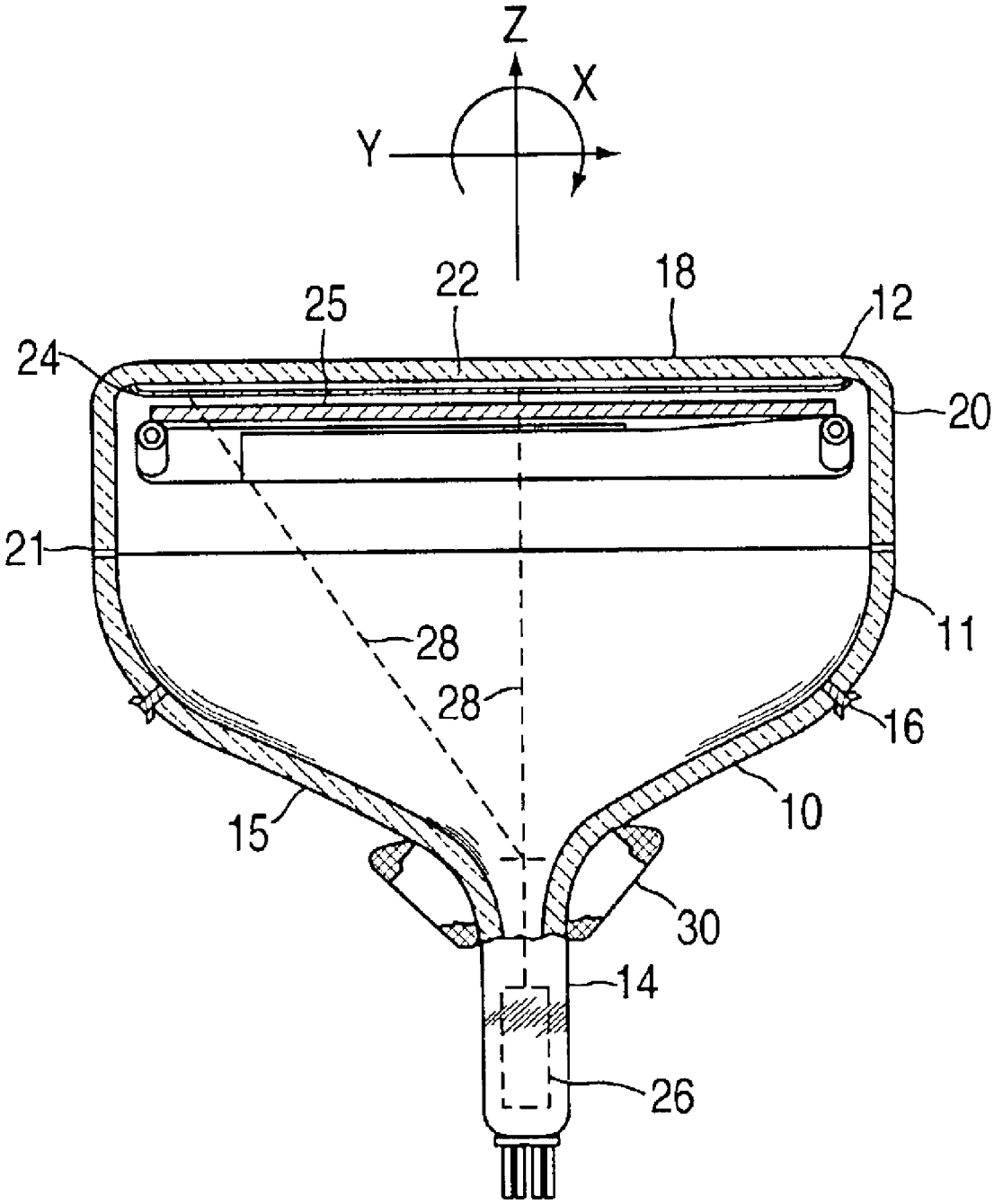
FIG. 1 is a plan view, partially in axial section, of a color cathode ray tube (CRT) made according to embodiments of the present invention.

FIG. 1 shows a conventional color cathode ray tube (CRT) 10 having a glass envelope 11 comprising a faceplate panel 12 and a tubular neck 14 connected by a funnel 15. The funnel 15 has an internal conductive coating (not shown) that is in contact with, and extends from, an anode button 16 to the neck 14.

Figure 2:
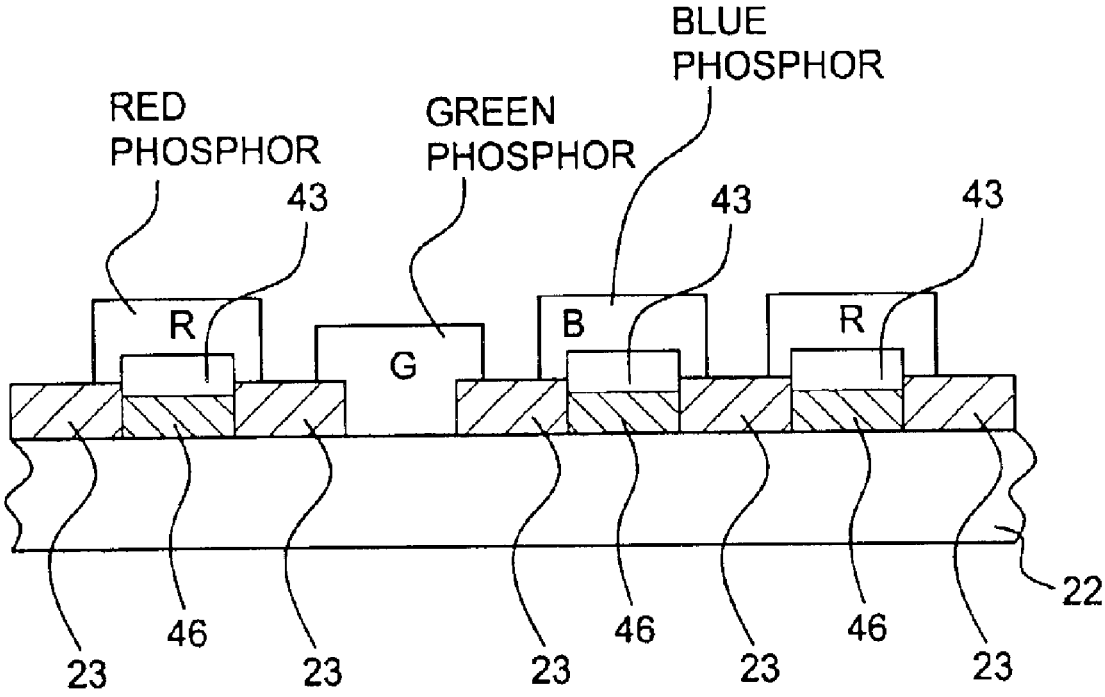
FIG. 2 is a section of the faceplate panel of the CRT of FIG. 1, showing a luminescent screen assembly.

The faceplate panel 12 comprises a viewing surface 18 and a peripheral flange or sidewall 20 that is sealed to the funnel 15 by a glass frit 21. A three-color luminescent phosphor screen 22 is carried on the inner surface of the faceplate panel 12. The screen 22, shown in cross-section in FIG. 2, is a line screen which includes a multiplicity of screen elements comprised of red-emitting, green-emitting and blue-emitting phosphor stripes R, G, and B, respectively, arranged in triads, each triad including a phosphor line of each of the three colors. The R, G and B phosphor stripes extend in a direction that is generally normal to the plane in which the electron beams are generated.

At least one of the R, G and B phosphor stripes are formed on color filters 43. The color filters 43 each comprise a pigment that corresponds to the color of the phosphor stripe formed thereon. The color filters 43 are formed on hardened photosensitive material 46.

A light-absorbing matrix 23, shown in FIG. 2, separates each of the phosphor lines. A thin conductive layer 24 (shown in FIG. 1), preferably of aluminum, overlies the screen 22 and provides means for applying a uniform first anode potential to the screen 22, as well as for reflecting light, emitted from the phosphor elements, through the viewing surface 18. The screen 22 and the overlying aluminum layer 24 comprise a screen assembly.

A multi-aperture color selection electrode, or shadow mask 25 (shown in FIG. 1) is removably mounted, by conventional means, within the faceplate panel 12, in a predetermined spaced relation to the screen 22.

An electron gun 26, shown schematically by the dashed lines in FIG. 1, is centrally mounted within the neck 14, to generate three inline electron beams 28, a center and two side or outer beams, along convergent paths through the shadow mask 25 to the screen 22. The inline direction of the beams 28 is approximately normal to the plane of the paper.

The CRT of FIG. 1 is designed to be used with an external magnetic deflection yoke, such as a yoke 30, shown in the neighborhood of the funnel-to-neck junction. When activated, the yoke 30 subjects the three beams 28 to magnetic fields that cause the beams 28 to scan a horizontal and vertical rectangular raster across the screen 22.

Figure 3:
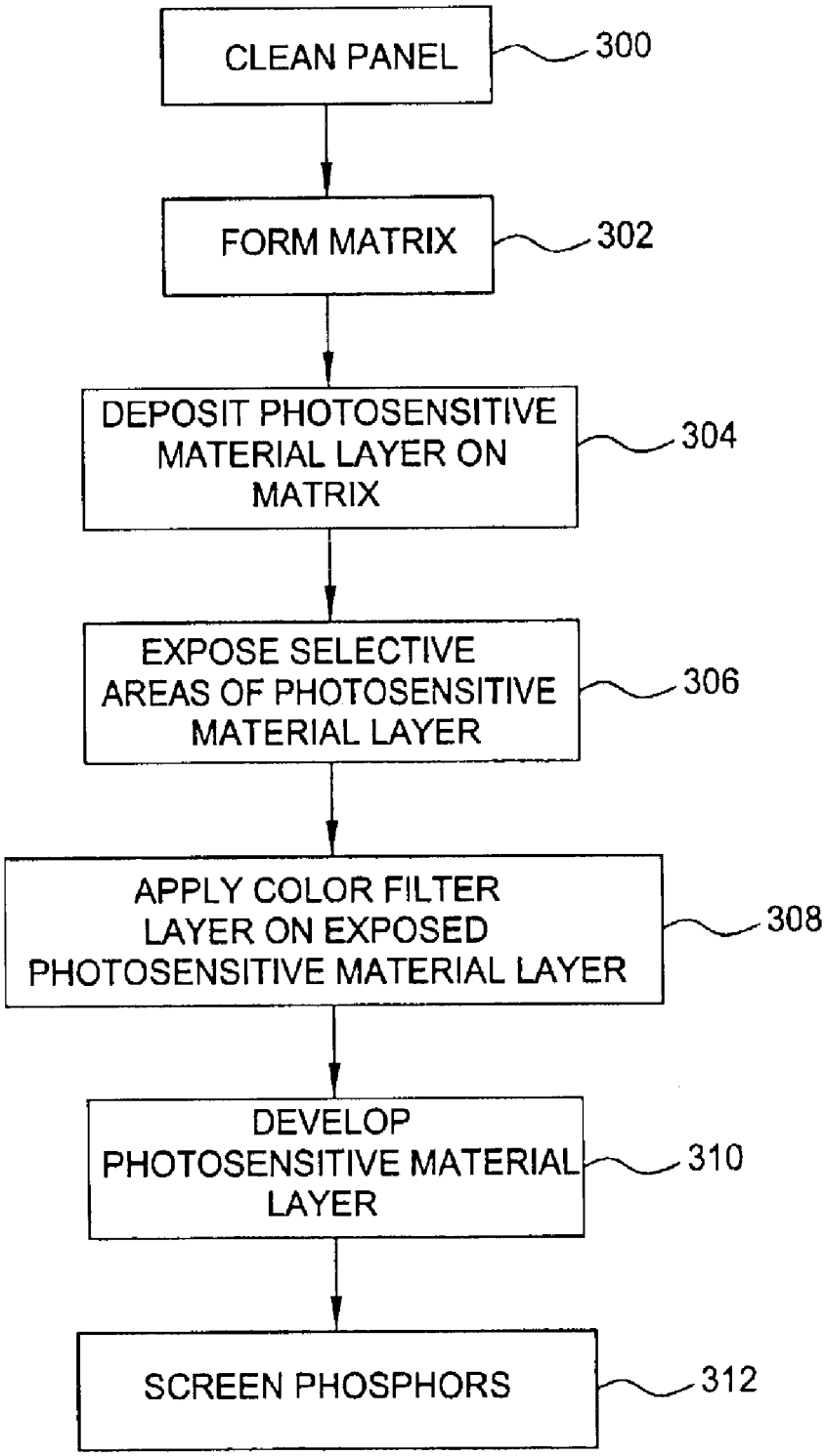
FIG. 3 is a block diagram comprising a flow chart of the manufacturing process for the screen assembly of FIG. 2.

The screen 22 is manufactured according to the process steps represented schematically in FIG. 3. Initially, the faceplate panel 12 can be cleaned, as indicated by reference numeral 300, by washing it with a caustic solution, rinsing it in water, etching it with buffered hydrofluoric acid and rinsing it again with water, as is known in the art.

The interior surface of the faceplate panel 12 is then provided with the light-absorbing matrix 23, as indicated by reference numeral 302, preferably using a wet matrix process in a manner described in U.S. Pat. No. 3,558,310 issued Jan. 26, 1971 to Mayaud, U.S. Pat. No. 6,013,400 issued Jan. 11, 2000 to LaPeruta et al., or U.S. Pat. No. 6,037,086 issued Mar. 14, 2000 to Gorog et al.

Figure 4A:
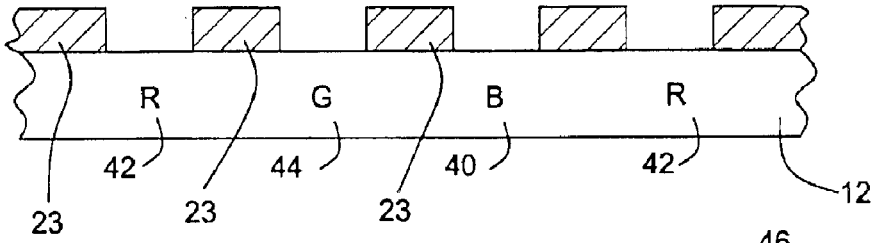
FIGS. 4A–4F depict views of the interior surface of the faceplate panel during formation of a luminescent screen assembly.

The light-absorbing matrix 23 is uniformly provided over the interior viewing surface of faceplate panel 12. For a faceplate panel 12 having a diagonal dimension of about 68 cm (27 inches), the openings or gaps formed between the lines of the light-absorbing matrix 23 can have a width in a range of about 0.075 mm to about 0.25 mm, and the opaque matrix lines can have a width in a range of about 0.075 mm to about 0.30 mm. Referring to FIG. 4A, the light-absorbing matrix 23 defines three sets of fields: a first set of fields 40, a second set of fields 42, and a third set of fields 44.

Figure 4B:
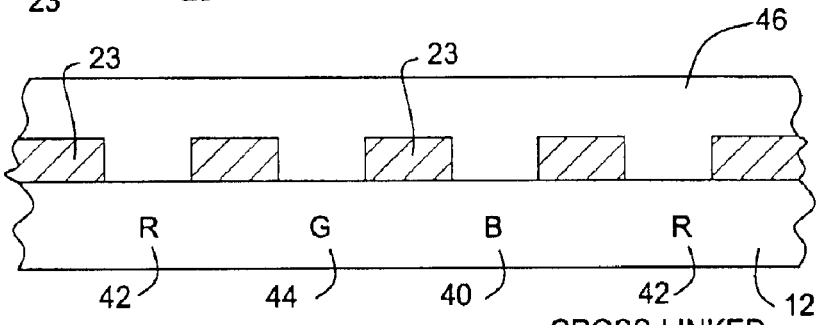

As indicated by reference numeral 304 in FIG. 3, as well as FIG. 4B, a photosensitive material layer 46 is deposited on the interior surface of the faceplate panel 12. The photosensitive material layer 46 may be formed from an aqueous solution of sodium dichromate and a polymer such as, for example, polyvinyl alcohol (PVA). The photosensitive material layer 46 may be formed on the faceplate panel 12 by spin coating the aqueous solution of the polymer and dichromate thereon. The thickness for the photosensitive material layer 46 should be within a range of about 0.5 micrometers to about 2.0 micrometers.

The photosensitive material layer 46 should have a viscosity within a range of about 10 centipoise (cps) to about 25 cps. The photosensitive material layer may include sodium dichromate within a range of about 6.0 weight % to about 12 weight % and the polymer (e.g., PVA) within a range of about 88 weight % to about 94 weight %.

Figure 4C:
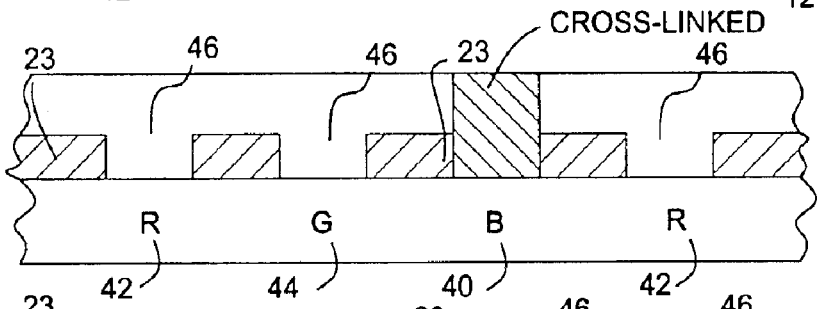

Referring to reference numeral 306 in FIG. 3, the photosensitive material layer 46 is irradiated using, for example, ultraviolet radiation, through the shadow mask 25 to cross-link the photosensitive material in the first set of fields 40. Cross-linking the photosensitive material layer 46 in the first set of fields 40 hardens the photosensitive material in such fields, as shown in FIG. 4C.

Figure 4D:
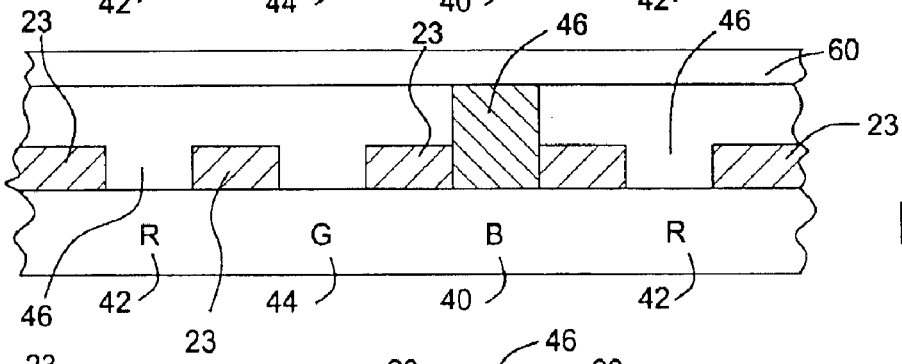

As indicated by reference numeral 308 in FIG. 3, as well as FIG. 4D, a first color filter layer 60 is applied over the photosensitive material layer 46 following the exposure step. The first color filter layer 60 may be applied from a first aqueous pigment suspension that may comprise, for example, a first pigment, one or more surface active agents and one or more gelling agents.

The first pigment may be, for example, a blue pigment, such as, daipyroxide blue pigment TM-3490E, commercially available from Daicolor-Pope, Inc. of Patterson, N.J. Another suitable blue pigment may include for example, EX 1041 blue pigment, commercially available from Shepherd Color Co. of Cincinnati, Ohio, among other pigments.

Alternatively, the first pigment may be a red pigment. Suitable red pigments may include, for example, daipyroxide red pigment TM-3875, commercially available from Daicolor-Pope, Inc. of Patterson, N.J. Another suitable red pigment may include, for example, R2899 red pigment, commercially available from Elementis Pigments Co. of Fairview Heights, Ill., among other red pigments.

The pigments may be milled using a milling process in which the pigment is dispersed along with one or more surfactants in an aqueous suspension. The blue pigment may be milled using for example, 1/16" zirconium oxide ($ZrO_2$) balls for at least about 61 hours to about 90 hours. The average particle size for the blue pigment should be about 115 nm (nanometers) after milling.

The red pigment may also be milled using, for example, 2 mm glass bead media for at least about 18 hours to about 92 hours. The average particle size for the red pigment should be about 90 nm after milling.

The one or more surface-active agents may include, for example, organic and polymeric compounds that may optionally adopt an electric charge in aqueous solution. The surface-active agent may comprise anionic, non-ionic, cationic, and/or amphoteric materials. The surface-active agent may be used for various functions such as improving the homogeneity of the pigment in the aqueous pigment suspension and improved wetting of the faceplate panel 12, among other functions. Examples of suitable surface-active agents include various polymeric dispersants such as, for example, DISPEX N-40V polymeric dispersant (commercially available from Ciba Specialty Chemicals of High Point, N.C.) as well as block copolymer surface-active agents such as Pluronic Series (ethoxypropoxy co-polymers) L-62, commercially available from Hampshire Chemical Company of Nashua, N.H., and carboxymethyl cellulose (CMC) commercially available from Yixing Tongda Chemical Co. of China.

The one or more gelling agents may include for example, organic and inorganic compounds that form gels with the polymer used in the photosensitive material layer. The gelling agent in the aqueous pigment suspension gels the polymer on the surface of the unhardened portion of the photosensitive material layer. Gelling the surface of the unhardened photosensitive material layer prevents dissolution of the polymer therein into the pigment suspension preventing the agglomeration of the pigment particles. Examples of suitable gelling agents for polyvinyl alcohol (PVA) include inorganic compounds such as, for example, boric acid ($H_3BO_3$), borax, ammonium vanadate, and copper salts, among others, as well as organic compounds such as, for example, Congo Red, resorcinol and salicyclanilide, among others.

The first aqueous pigment suspension should include pigment within a range of about 5 weight % to about 17 weight %. Additionally, the first aqueous pigment suspension should include the gelling agent within a range of about 1 weight % to about 5 weight %.

The first aqueous pigment suspension may be applied to the faceplate panel by, for example, spin coating in order to form the first color filter layer 60 over the photosensitive material layer 46 on the interior surface of the faceplate panel 12 following the exposure step. After spin coating, the first color filter layer 60 may be heated to a temperature in a range from about 50° C. to about 70° C. and than cooled to about 40° C.

Figure 4E:
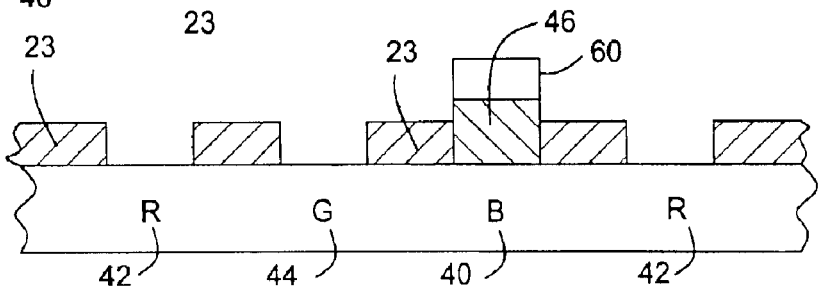

Referring to reference numeral 310, after the first color filter layer 60 is formed, the photosensitive material layer 46 is developed. The photosensitive material layer 46 may be developed using, for example, deionized water. After development, the photosensitive material layer 46 and overlying first color filter layer 60 is removed in the second set of fields 42 and the third set of fields 44, while remaining on the faceplate panel 12 in the first set of fields 40, as shown in FIG. 4E.

The color filter formation process described above with reference to FIGS. 4B–4E, may then be repeated to form a second or third color filter in the second set of fields 42 or the third set of fields 44, respectively.

Figure 4F:
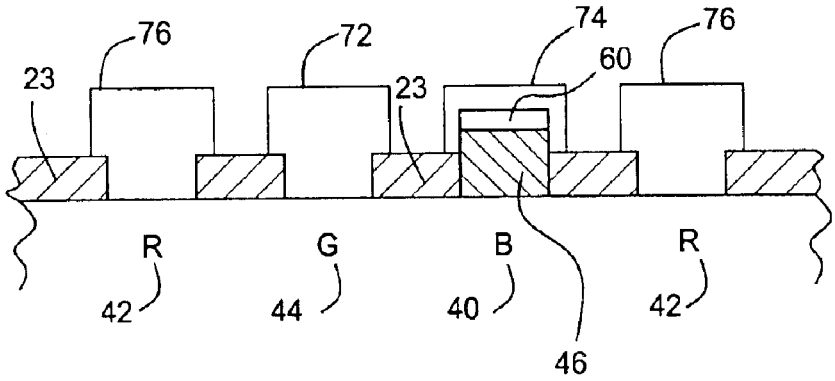

The faceplate panel 12 is then screened with non-pigmented green phosphors 72, non-pigmented blue phosphors 74 and non-pigmented red phosphors 76, as indicated by reference numeral 312 in FIG. 3, as well as FIG. 4F, preferably using a screening process in a manner known in the art.

Figure 5A:
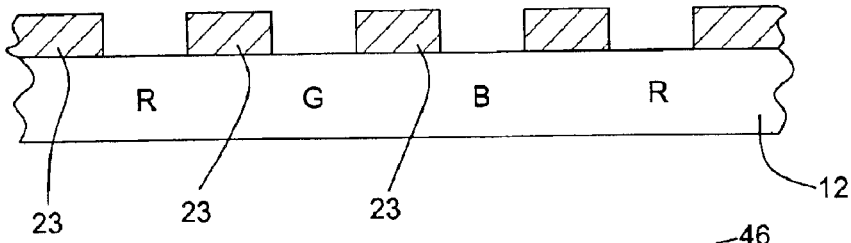
FIGS. 5A–5M depict views of the interior surface of the faceplate panel during formation of an exemplary luminescent screen assembly.

In an exemplary luminescent screen assembly fabrication process, a 27-inch faceplate panel 12 having matrix lines formed thereon was provided, as shown in FIG. 5A. The matrix lines defined three sets of fields: blue fields, B, red fields, R, and green fields, G.

Figure 5B:
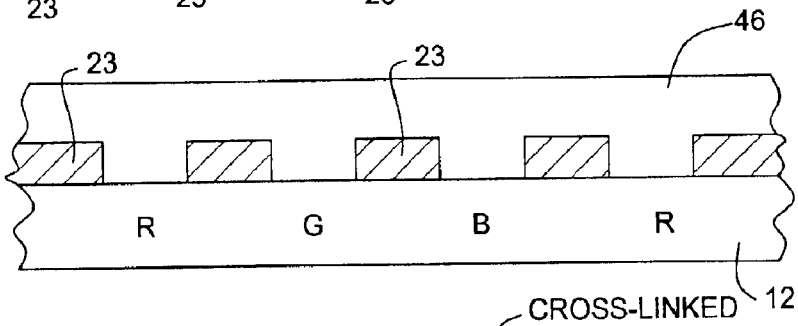

A 225 ml (milliliter) solution of 1000 grams of deionized water, 320 grams of 10% polyvinyl alcohol (PVA) and 42 grams of 10% sodium dichromate was applied to the faceplate panel. The solution had a viscosity of 12.5 cps (centipoise). The faceplate panel was spun at 8 rpm for 22 seconds while the 225 ml solution was applied thereto, and then at 170 rpm for 30 seconds, heated to 52.5° C. and cooled to 40° C. to form a first photosensitive material layer 46 thereon, as shown in FIG. 5B.

The coated faceplate panel 12 was irradiated using an ultraviolet source (4.0 $W/m^2$) at two source positions through a corresponding shadow mask, to cross-link (harden) the photosensitive material in the blue fields, B. The first source position was at −0.130 mils for 30 seconds and the second source position was at −0.174 mils for 30 seconds: these dimensions refer to the exposure source positions with respect to a central source position of 0 mils, corresponding to that used for the exposure of the green phosphor on a lighthouse.

An aqueous blue pigment suspension was prepared by mixing 50 grams of TM-3490E Daipyroxide blue pigment (commercially available from Daicolor-Pope, Inc. of Patterson, N.J.) and 3 grams of a polymeric dispersant DISPEX N-40V (commercially available from Ciba Specialty Chemicals of High Point, N.C.) with 200 grams of water in a mill containing 1/16" zirconium oxide ($ZrO_2$) balls for 66 hours. The blue pigment suspension recovered from the mill was diluted to 14 weight % pigment solids with water. Five and one half (5.5) grams of boric acid ($H_3BO_3$) was added to the suspension to make the concentration of boric acid about 2 weight %. Thereafter, two drops of (about 0.1 gram) of 10% Triton X-100 (commercially available from Dow Chemical Co. of Houston, Tex.) were added the mixture, and the resulting suspension was mixed on a roller for another hour.

Figure 5C:
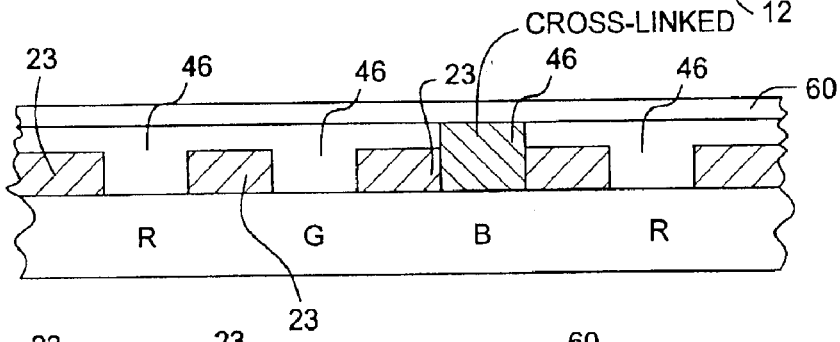

Two hundred grams of the blue pigment suspension was then applied to the faceplate panel at room temperature. The faceplate panel was spun at 8 rpm for 52 seconds while the blue pigment suspension was applied thereto and then at 100 rpm for 20 seconds, heated to 51.5° C., and cooled to 40° C. to form a blue color filter layer 60 on the faceplate panel 12, as shown in FIG. 5C.

Figure 5D:
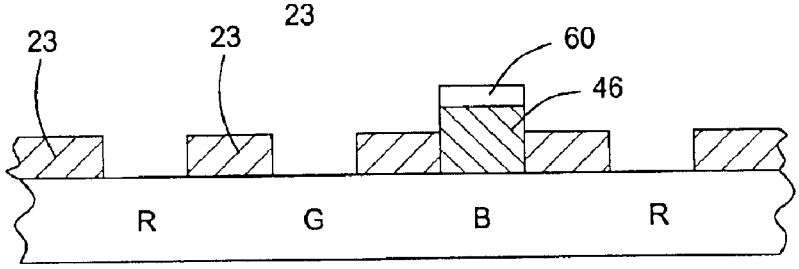

The first photosensitive material layer 46 was developed using 43° C. water at 30 psi for 30 seconds and then dried. This resulted in the formation of a blue color filter 60 on the hardened first photosensitive material 46 in the blue fields, B, with the removal of the first photosensitive material layer 46 with the blue color filter 60 thereon in the red fields, R, and the green fields, G, as shown in FIG. 5D.

Figure 5E:
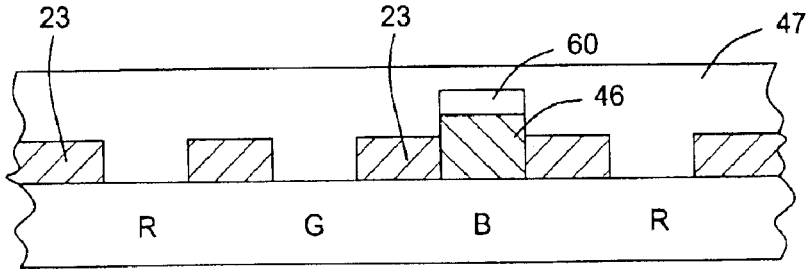

A 225 ml solution of 1000 grams of deionized water, 320 grams of 10% polyvinyl alcohol (PVA) and 42 grams of 10% sodium dichromate was applied to the faceplate 12. The solution had a viscosity of 12.5 cps. The faceplate panel was spun at 8 rpm for 22 seconds while the 225 ml solution was applied thereto, and then at 170 rpm for 30 seconds, heated to 51.5° C. and cooled to 40° C. to form a second photosensitive material layer 47 thereon, as shown in FIG. 5E.

The coated faceplate panel 12 was irradiated using an ultraviolet source (4.0 $W/m^2$) at two source positions through a corresponding shadow mask, to cross-link (harden) the photosensitive material in the red fields, R. The first source position was at +0.122 mils for 30 seconds and the second source position was at +0.166 mils for 30 seconds: these dimensions refer to the exposure source positions with respect to a central source position of 0 mils, corresponding to that used for the exposure of the green phosphor on a lighthouse.

An aqueous red pigment suspension was prepared by mixing 50 grams of TM-3875 Daipyroxide red pigment (commercially available from Daicolor-Pope, Inc. of Patterson, N.J.) and 8 grams of a polymeric dispersant A-40 (commercially available from Ciba Specialty Chemicals of High Point, N.C.) with 200 grams of water in a mill containing 2 mm glass bead media for 66 hours. The red pigment suspension recovered from the mill was diluted to 6 weight % pigment solids with water. Fourteen and eight-tenths (14.8) grams of boric acid ($H_3BO_3$) was added to the suspension to make the concentration of boric acid about 2 weight %. Thereafter, 2 drops of 10% Triton X-100 surfactant (commercially available from Dow Chemical Co. of Houston, Tex.) was added to the suspension and the mixture was mixed on a roller for another hour.

Figure 5F:
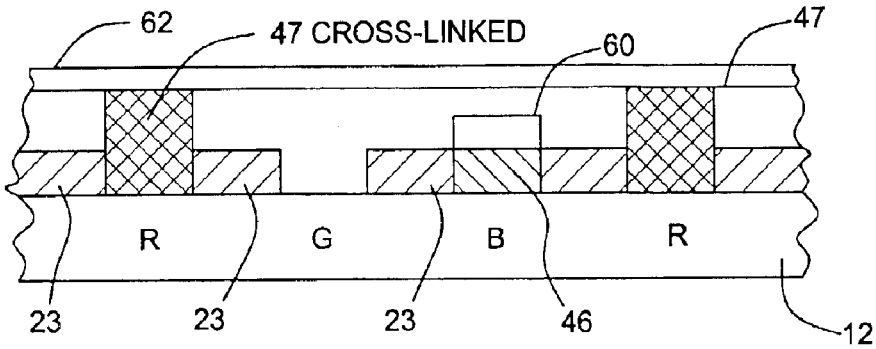

Two hundred grams of the red pigment suspension was then applied to the faceplate panel at room temperature. The faceplate panel was spun at 8 rpm for 52 seconds while the red pigment suspension was applied thereto and then at 100 rpm for 20 seconds, heated to 67° C., and cooled to 40° C. to form a red color filter layer 62 on the faceplate panel 12, as shown in FIG. 5F.

Figure 5G:
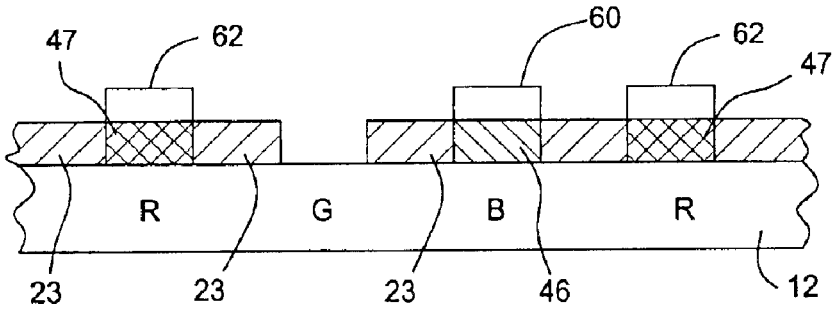

The second photosensitive material layer 47 was developed using 43° C. water at 30 psi for 30 seconds and then dried. This resulted in the formation of a red color filter 62 on the hardened second photosensitive material layer 47 in the red fields, R, with removal of the second photosensitive material layer 47 with the red color filter 62 thereon in the blue fields, B, and the green fields, G, as shown in FIG. 5G.

Figure 5H:
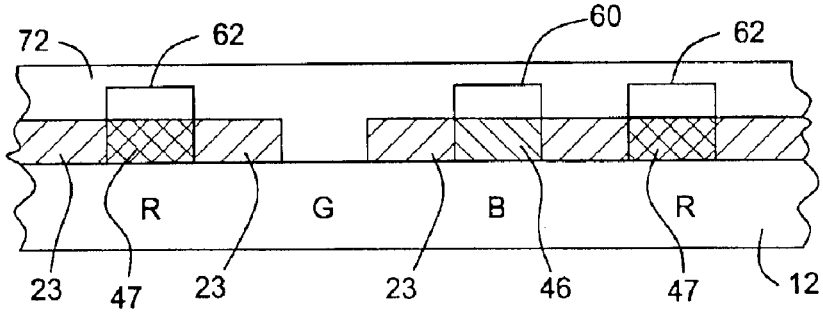
Figure 5I:
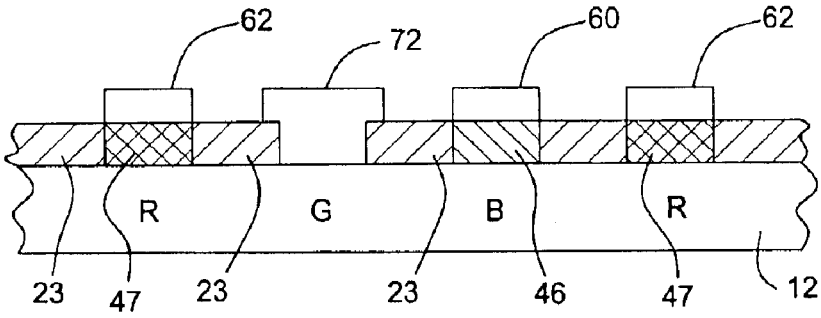

Two hundred twenty-five milliliters of a non-pigmented green slurry, comprising 150 grams of 10% polyvinyl alcohol, 14 grams of 10% sodium dichromate, 5 grams of 5% Pluronic Series (ethoxypropoxy co-polymer) L-92 (commercially available from BASF Corp. of Germany), 8.5 grams tetra(ethylene glycol) (TEG), 0.4 grams of 25% TAMOL (polycarbonate salt) surfactant (commercially available form Rhom & Haas Co., Philadelphia, Pa.), 1.3 grams of 30% TWEEN-20 (polysorbate) (commercially available from Atlas Chemical Co., Chicago, Ill.), and 200 grams of GR525-TCG-2 phosphor (zinc sulfide silver, aluminum, gold doped phosphor) (commercially available from USR Optonix Inc., Hackettstown, N.J.) in 240 grams of deionized water, was then applied to the faceplate panel. The faceplate panel was spun at 8 rpm for 67 seconds while the non-pigmented green slurry was applied thereto and then at 170 rpm for 25 seconds, heated to 51° C., and cooled to 35° C. to form a non-pigmented green phosphor layer 72 on the faceplate panel 12, as shown in FIG. 5H.

The coated faceplate panel 12 was irradiated using an ultraviolet source (4.0 $W/m^2$) through a corresponding shadow mask, to cross-link the non-pigmented green phosphor layer 72 in the green fields, G. The green fields were irradiated for 25 seconds. The irradiated faceplate panel 12 was developed using 43° C. water at 30 psi for 30 seconds and then dried. This resulted in the formation of a non-pigmented green phosphor layer 72 in the green fields, G, with removal of the non-pigmented green phosphor layer 72 in the red fields, R, and the blue fields, B, as shown in FIG. 51.

Figure 5J:
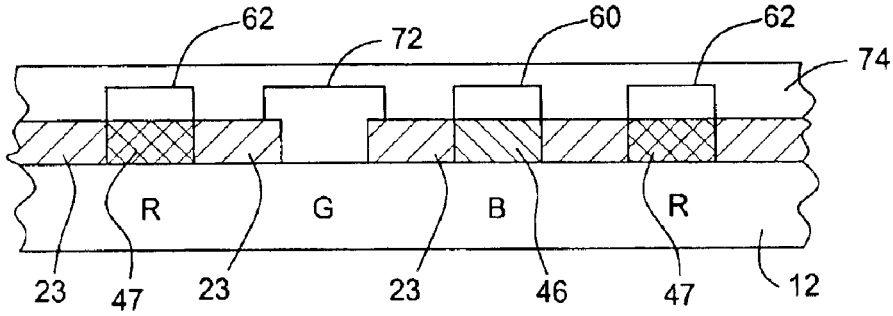

Two hundred twenty-five milliliters of a non-pigmented blue slurry, comprising 150 grams of 10% polyvinyl alcohol, 11.5 grams of 10% sodium dichromate, 5 grams of 5% Pluronic Series L-92 (ethoxypropoxy co-polymer) (commercially available from BASF Corp. of Germany), 4.5 grams tetra(ethylene glycol) (TEG), 0.6 grams of 25% TAMOL (polycarbonate salt) surfactant (commercially available from Rhom & Haas Co., Philadelphia, Pa.), 1.3 grams of 30% TWEEN-20 (polysorbate) (commercially available from Atlas Chemical Co., Chicago, Ill.), and 200 grams BL361 phosphor (zinc sulfide silver doped phosphor) (commercially available from USR Optonix Inc., Hackettstown, N.J.), in 240 grams of deionized water, was then applied to the faceplate panel. The faceplate panel was spun at 8 rpm for 67 seconds while the non-pigmented blue slurry was applied thereto and then at 170 rpm for 30 seconds, heated to 51° C., and cooled to 35° C. to form a non-pigmented blue phosphor layer 74 on the faceplate panel, as shown in FIG. 5J.

Figure 5K:
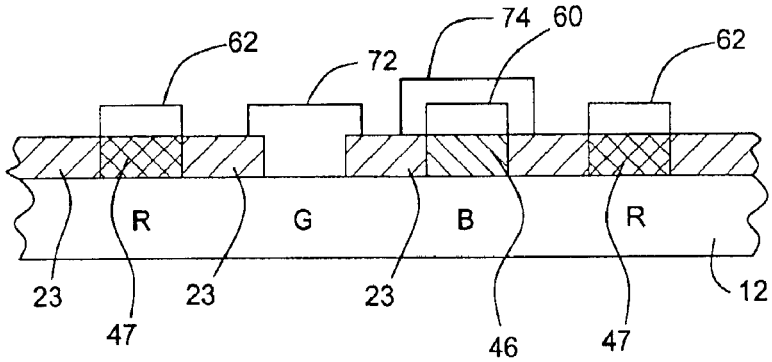

The coated faceplate panel was irradiated using an ultraviolet source (4.0 $W/m^2$) through a corresponding shadow mask, to cross-link the non-pigmented blue phosphor layer 74 in the blue fields, B. The blue fields were irradiated for 34 seconds. The irradiated faceplate panel was developed using 43° C. water at 30 psi for 30 seconds and then dried. This resulted in the formation of a non-pigmented blue phosphor layer 74 on the blue color filter 60 in the blue fields, B, with the removal of the non-pigmented blue phosphor layer 74 in the red fields, R, and the green fields, G, as shown in FIG. 5K.

Figure 5L:
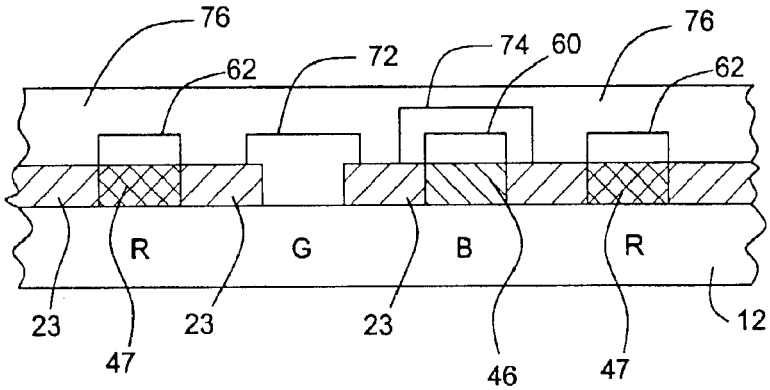

Two hundred twenty-five milliliters of a non-pigmented red slurry, comprising 160 grams of 10% polyvinyl alcohol, 21 grams of 10% sodium dichromate, 5 grams of 5% Pluronic Series L-92 (ethoxypropoxy co-polymer) (commercially available from BASF Corp. of Germany), 3 grams tetra(ethylene glycol) (TEG), 6 grams of 25% TAMOL (polycarbonate salt) surfactant (commercially available from Rhom & Haas Co., Philadelphia, Pa.), 1.3 grams of 30% TWEEN-20 (polysorbate) (commercially available from Atlas Chemical Co., Chicago, Ill.), and 200 grams RE555 phosphor (yttrium oxysulfide europium doped phosphor) commercially available from USR Optonix, Hackettstown, N.J.), in 275 grams of deionized water, was then applied to the faceplate panel. The faceplate panel was spun at 8 rpm for 67 seconds while the non-pigmented red slurry was applied thereto and then at 170 rpm for 26 seconds, heated to 51° C., and cooled to 35° C. to form a non-pigmented red phosphor layer 76 on the faceplate panel, as shown in FIG. 5L.

Figure 5M:
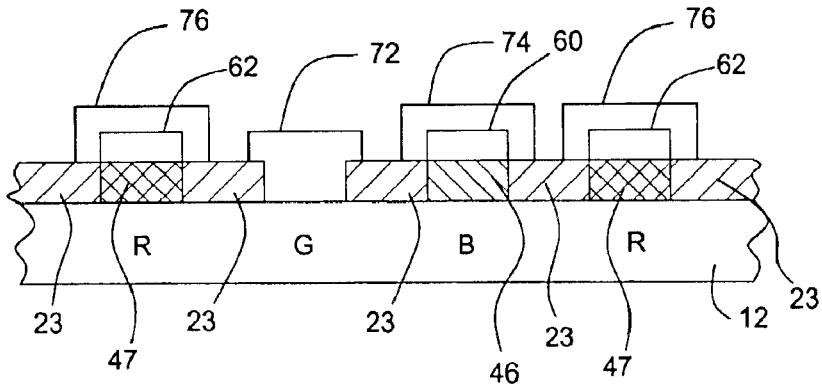

The coated faceplate panel was irradiated using an ultraviolet source (4.0 $w/m^2$) through a corresponding shadow mask, to cross-link the non-pigmented red phosphor layer 76 in the red fields, R. The red fields were irradiated for 23 seconds. The irradiated faceplate panel was developed using 43° C. water at 30 psi for 30 seconds and then dried. This resulted in the formation of a non-pigmented red phosphor layer 76 on the red color filter layer 62 in the red fields, with the removal of the non-pigmented red phosphor layer 76 in the blue fields, B, and the green fields, G, as shown in FIG. 5M.

The resulting faceplate panel showed no visible degradations in the structures of either the red color filter or the blue color filters. Additionally, there was no degradation of the phosphor lines.

What is claimed is:

1. A method of manufacturing a cathode-ray tube (CRT) having a luminescent screen assembly, comprising:

providing a faceplate panel having a patterned light-absorbing matrix thereon defining a plurality of sets of fields; forming a photosensitive material layer on the patterned light-absorbing matrix;

cross-linking the photosensitive material layer in one set of fields; applying a pigment layer on the cross-linked photosensitive material layer; and developing the photosensitive material layer to remove the pigment layer in the plurality of sets of fields having non-cross-linked photosensitive material thereon.

2. The method of claim 1 wherein the photosensitive material layer is formed from an aqueous solution of a photosensitizer and a polymer.

3. The method of claim 2 wherein the aqueous solution of the photosensitizer and the polymer has a viscosity within a range of about 10 centipoise to about 25 centipoise.

4. The method of claim 2 wherein the polymer is polyvinyl alcohol (PVA).

5. The method of claim 1 wherein the pigment layer is formed from an aqueous solution of a pigment, one or more surface-active agents and a gelling agent.

6. The method of claim 5 wherein the pigment is selected from the group consisting of blue pigment, red pigment and green pigment.

7. The method of claim 5 wherein the gelling agent is present in the aqueous solution in a concentration within a range of about 1 weight % to about 5 weight %.

8. The method of claim 5 wherein the gelling agent is selected from the group consisting of boric acid (H3BO3), borax, ammonium vanadate, copper salts, Congo Red, resorcinol and salicyclanilide.

* * * * *